US006147933A

United States Patent [19]

Bland et al.

[11] Patent Number: 6,147,933

[45] Date of Patent: Nov. 14, 2000

[54] TIMEPIECE AND CHRONOMETER WITH OVERLAPPING, SEPARATELY DRIVEN ANALOG AND DIGITAL DISPLAYS

[75] Inventors: Diarmuid John St. Colum Bland; Carla Louise Carr, both of Garland; Jeffrey Keith Bruneau, Dallas; William Warren Morgan, III, The Colony, all of Tex.

[73] Assignee: Fossil, Inc., Richardson, Tex.

[21] Appl. No.: 09/507,230

[22] Filed: Feb. 18, 2000

Related U.S. Application Data

[63] Continuation of application No. 09/290,902, Apr. 12, 1999, Pat. No. 6,084,828

[60] Provisional application No. 60/111,886, Dec. 11, 1998.

[30] Foreign Application Priority Data

Sep. 28, 1998 [CN] China ..... 98327438

[51] Int. Cl.[7] ..... G04B 19/09; G04B 37/00; G04C 19/00

[52] U.S. Cl. ..... 368/80; 368/82; 368/88; 368/223

[58] Field of Search ..... 368/80, 82–84, 368/88, 107–113, 223, 239, 242

[56] References Cited

U.S. PATENT DOCUMENTS 3,911,665 10/1975 Van Berkum ..... 368/82
4,320,484 3/1982 Burdet ..... 368/239
4,355,380 10/1982 Huggerin et al. ..... 368/71
4,413,915 11/1983 Besson ..... 368/71
4,488,818 12/1984 Saurer et al. ..... 368/71

*Primary Examiner*—Vit Miska

[57] ABSTRACT

A timepiece and chronometer with a superimposed analog/digital display arrangement. The timepiece comprises a watch case with a back and a display area, a transparent crystal, an electrically-driven digital LCD display, a superimposed analog display comprising an hour hand, minute hand, and interior bezel, an electrical analog watch movement, and a digital display driver. The digital LCD display indicates passing seconds by incrementally displaying either digits 00 through 59 or digits 01 through 60 for one second each, either in dark numerals over a light background, or vice versa. The analog display is driven by an electrical watch movement located beneath the LCD display that comprises a battery, a timing standard, timing circuitry, a stem and crown assembly, and a hand moving assembly that extends upward through the center aperture of the LCD display and couples to the analog watch hands. The digital display driver, also located behind the LCD display, couples to the digital LCD display and comprises a second battery, a timing standard, and timing and display driving electronic components and circuitry. The analog movement and the digital display driver may share the same electrical ground, but otherwise are electrically isolated from one another.

10 Claims, 6 Drawing Sheets

TIMEPIECE AND CHRONOMETER WITH OVERLAPPING, SEPARATELY DRIVEN ANALOG AND DIGITAL DISPLAYS

This is a continuation of application Ser. No. 09/290,902, now U.S. Pat. No. 6,084,828, filed Apr. 12, 1999.

This application claims the benefits of the earlier filed Chinese Patent Application No. 98327438.X, filed in the Patent Office of the People's Republic of China on Sep. 28, 1998, and U.S. Provisional Application Serial No. 60/111,886, filed in the US Patent Office on Dec. 11, 1998. In addition, applicants have sought protection of certain decorative elements of the present invention in Chinese Design Patent No. ZL98318505.0, filed on Jun. 6, 1998 and issued by the Patent Office of the People's Republic of China on Jan. 20, 1999, and U.S. Design Patent Application Serial No. 29/097,667, filed in the US PTO on Dec. 11, 1998. All four of these documents are incorporated by reference into this application for all purposes.

BACKGROUND OF THE INVENTION

1. Field of the Invention

The present invention relates to the field of electronic timepieces, meaning timepieces having an electronic oscillator, such as a quartz crystal oscillator, that serves as the time standard for the timepiece. More specifically, the present invention relates to display technologies for electronic timepieces, where the display arrangement includes both analog and digital time indicators.

2. Description of the Related Art

To receive reasonable consumer acceptance, a modern electronic wristwatch or other body-worn timepiece must have certain basic features and capabilities. First, it must be fairly accurate—errors of less than 10 seconds per month are common in the industry. It must be convenient to operate and have a highly visible time display—preferably a display easily visible in both bright sunlight and low light conditions. The cost of acquiring and maintaining the timepiece must be reasonable. Finally, it must have a combination of features, displays, and overall appearance that are sufficiently innovative or otherwise appealing to make consumers want to wear it.

Watches that incorporate both a conventional, mechanically-driven, analog-type display and a digital, electrically-driven display have become popular as both consumers and manufacturers have realized that both types of displays have certain advantages in electronic body-worn timepiece applications. When electronic watches were new, consumers typically wanted to "advertise" that they possessed an electronic watch by having some sort of visible digital display. At the time, "solid state" watches were considered by many to be more reliable, more prestigious, and more desirable than their old-fashioned, mechanically-driven counterparts. Watch manufacturers thus sought to meet consumer demand by developing digital electro-optical displays that were suitable for electronic wristwatch applications.

However, the initial digital-display watches offered by manufacturers had many shortcomings. Wristwatches with digital light-emitting diode (LED) displays were bulky and consumed so much power that the display was ordinarily off, requiring inconvenient two-handed operation by the wearer to command the display to "turn on." Moreover, while LED displays were highly visible at night, they were very hard to read in bright sunlight. The earliest liquid crystal displays (LCD) used in electronic watches consumed far less power than LEDs, but these displays typically had an unacceptably short lifetime. The first LCDs also had contrast problems that limited users to fairly narrow viewing angles. Advances in electronics, display, and battery technology have resolved many of these problems, making current electro-optical displays much more practical for body-worn timepiece applications.

However, although currently available digital displays are far more serviceable for watch applications than were their predecessors, consumers' preferences have changed. As electronic watches became readily and cheaply available in the market, their "prestige" wore off. Consumers also came to realize that while a digital display was convenient in some respects, it was inconvenient in many others. Generally speaking, it is easier to tell the time by glancing at an analog clock face than by reading a relatively small set of numbers. Moreover, consumers are thought to prefer analog displays to quickly assess time intervals, i. e., how much time has elapsed since a specified time or how much time remains before a specified time. For example, if it is currently 2:25 and one has an appointment at 3:00, consumers may find it easier to determine from an analog display that the appointment is 35 minutes away.

For these reasons, electronic wristwatches that contain complimentary analog and digital displays have become popular. A number of these types of wristwatches actually do not contain analog components, but rather, utilize an electronic display that simulates an analog display. The following U.S. Patents all disclose dual electronic displays where the analog-like portion of the display (i.e., a radial display similar to a clock face that is intended to convey the time of day in hours and minutes) does not include a conventional, motor-driven hour hand and minute hand: U.S. Pat. No.4,198,810, issued on Apr. 22, 1980 to Fahrenschon; U.S. Pat. No. U.S. Pat. No. 4,077,032, issued on Feb. 28, 1978 to Volkman; U.S. Pat. No. 4,095,405, issued on Jun. 20, 1978 to Tanaka; and U.S. Pat. No. 4,320,484, issued on Mar. 16, 1982, to Burdet.

On the other hand, U.S. Pat. No. 3,911,665, issued on Oct. 14, 1975 to van Berkum, discloses a wristwatch having complimentary mechanically-driven analog and electrically-driven digital displays. However, van Berkum's alphanumeric digital display is limited to the on-command display of the date. At the user's command, passing seconds can be electronically displayed via a "seconds marker," described as a single LED or a relatively small group of LEDs that flash at the rate of 1 Hz. U.S. Pat. No. 4,436,435, issued on Mar. 13, 1984 to Ushikoshi, discloses a wristwatch having complimentary analog and digital displays, where the digital display is located above (or in approximately the same plane) as the analog watch dial, thus allowing for a thin overall design. The wristwatch disclosed by Ushikoshi provides a conventional analog display that may or may not include a second hand, and a complimentary digital display that indicates hours and minutes in alphanumeric format. The digital display may or may not also include an alarm indicator and a flashing colon between the hours and minutes that indicates passing seconds. In Ushikoshi's wristwatch, both displays are driven by a single battery and a single time standard and timing circuit.

The present invention comprises a dual-display electronic wristwatch that incorporates a novel arrangement of the analog and digital displays, and utilizes separate batteries, time standards, and driving circuits for each display. Rather than displaying the same time-of-day information in two separate formats, or related time/date information, as disclosed in the above-described prior art, the present invention displays time-of-day information in analog format and passing seconds in alphanumeric format. Thus, the present invention is both a timepiece and a chronometric instrument, enabling the user to readily ascertain the both the time-of-day and the elapsed time between successive events with reasonable precision. Finally, the present invention provides a particularly unique and appealing appearance.

SUMMARY

The present invention is a timepiece and chronometer that displays the time of day in an analog display format superimposed over passing seconds alphanumerically displayed on an LCD digital display. The timepiece comprises a watch case with a display opening that, for the purposes ofthis disclosure, is designated as the display area, a transparent watch crystal, an electrically-driven digital LCD display that is substantially the same size as the display area, an electrical digital display driver, a conventional electrical analog watch movement, and an analog display comprising an hour hand, minute hand, and an interior bezel. The digital LCD display indicates passing seconds by incrementally displaying either digits 00 through 59 or digits 01 through 60 for one second each, either in dark numerals over a light background, or vice versa. The analog display, which may include luminescent surfaces on one or more of its components, is superimposed over the digital display, and arranged such that the digital LCD display is viewed through the opening of the interior bezel. The hands of the analog display are driven by an electrical analog watch movement located beneath the LCD display that comprises a battery, a timing standard such as a quartz crystal oscillator, timing circuitry, a conventional stem and crown assembly, and a hand moving assembly that extends upward through the LCD display and couples to the analog watch hands. The digital display driver, also located behind the LCD display, couples to the digital LCD display and comprises a battery, a timing standard such as a quartz crystal oscillator, and timing and display driving circuitry. The analog movement and the digital display driver may share the same electrical ground, but otherwise are electrically isolated from one another.

The timepiece may also include markings on the interior bezel that facilitate reading the time of day from the analog display, and/or one or more outer bezels coupled to the watch case outside the display area that are marked with analog time indications. The watch case may also include a curved rear surface to insure a comfortable fit at the wrist.

BRIEF DESCRIPTION OF THE DRAWINGS

To further aid in understanding the invention, the attached drawings help illustrate specific features of the invention and the following is a brief description of the attached drawings.

DETAILED DESCRIPTION OF THE INVENTION

The present invention comprises a dual-display electronic timepiece that incorporates a novel arrangement of the analog and digital displays, and utilizes separate batteries, time standards, and driving circuits for each display. Rather than displaying the same time-of-day information in two separate formats, or related time/date information, as disclosed in the above-described prior art, the present invention displays time-of-day information in analog format and passing seconds in alphanumeric format. Finally, the present invention provides a particularly unique and appealing appearance. This disclosure describes numerous specific details that include specific structures and circuits in order to provide a thorough understanding of the present invention. One skilled in the art will appreciate that one may practice the present invention without these specific details. In addition, while this disclosure focuses on the application of the present invention to wristwatches, one skilled in the art will recognize that the present invention can be also be applied in the context of any horological instrument.

Figure 1:
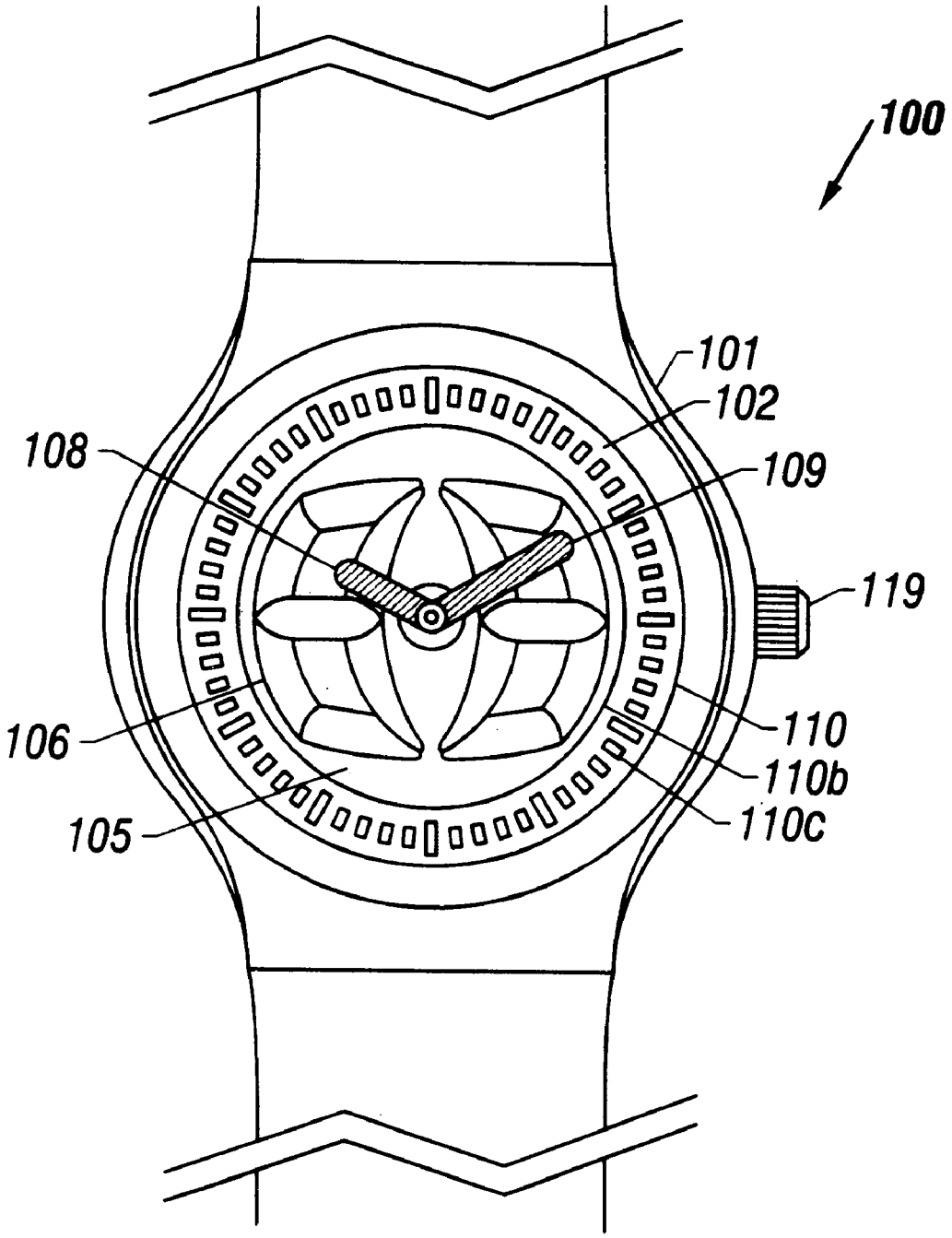
FIG. 1 is a plan view of one embodiment of the present invention in a wristwatch application, showing the analog display superimposed over the digital display, as it would appear to a wearer.

FIG. 1 shows the present invention 100 in a wristwatch embodiment, as it would appear to a wearer. As shown in FIG. 1, timepiece 100 includes a watch case 101. Looking through the transparent crystal 104 (not shown in FIG. 1) and the display opening 102 in watch case 101, the wearer sees the digital display 105 and its alphanumeric digits 106. Superimposed over the digital display 105, the wearer sees an hour hand 108, a minute hand 109, and an interior bezel 110 that comprise the analog display. Interior bezel 110 is symmetrically aligned with display opening 102, and further comprises an inner edge 110b that defines the inner opening of the interior bezel 110 and markings 110*c* that facilitate the reading of the time of day indicated by the position of the hour hand 108 and the minute hand 109. Alphanumeric digits 106 displayed on digital LCD display 105 are sized such that they can be viewed through the inner opening of interior bezel 110, without being blocked by interior bezel 110.

In the embodiment shown in FIG. 1, interior bezel markings 110*c* comprise long segments radially dispersed at approximate 15 degree intervals, and short segments radially dispersed between the long segments at approximate 3 degree intervals. While FIG. 1 shows short and long segments that indicate conventional hour and minute positions on a clock, one skilled in the art will recognize that interior bezel markings 110*c* could comprise a variety of other indications such as Roman, Arabic, or other alphanumeric characters, alone or combined with segments, dots or other markings or indications intended to facilitate the determination of the time of day indicated by the positions of hour hand 108 and minute hand 109. In a preferred embodiment of the present invention, a luminescent material or coating may be applied to the viewing surface of hour hand 108, minute hand 109, and either interior bezel markings 110*c*, or the surface of interior bezel 110, thus enabling the wearer to easily read the analog display in low ambient lighting conditions. Hour hand 108 and minute hand 109 are set as in a conventional timepiece using stem and crown assembly 119.

Figure 2:
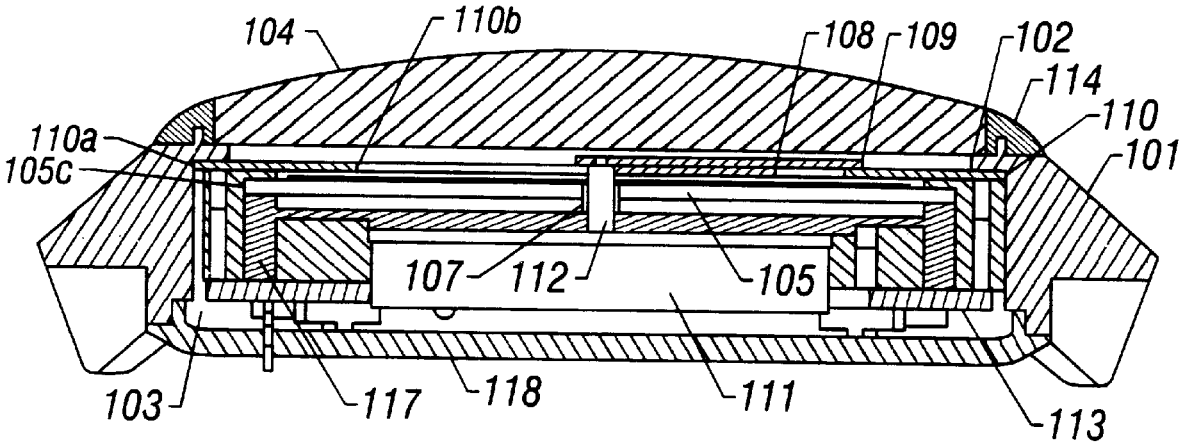
FIG. 2 is a cross-sectional view of one embodiment of the present invention in a wristwatch application, showing the arrangement of the displays, analog movement, and digital display driver within the watch case.

FIG. 2 is a cross-sectional view ofa wristwatch embodiment of the present invention, showing the arrangement of the various components within the interior 103 of the watch case 101 and case back 118. As shown in FIG. 2, watch crystal 104 covers display opening 102 in watch case 101. Watch crystal 104 is retained by outer bezel 114, which may or may not be marked with indications intended to facilitate reading the time-of-day from the position of watch hands 108 and 109. Immediately beneath watch crystal 104, FIG. 2 shows a cross-sectional view of minute hand 109, hour hand 108, and interior bezel 110. Analog hands 108 and 109 are coupled to and rotate about hand moving assembly 112, which extends upward from analog watch movement 111 through center aperture 107 in LCD digital display 105. Center aperture 107 is symmetrically aligned with interior bezel 110 and display opening 102. Analog hands 108 and 109 can be manually positioned using stem and crown assembly 119 (not shown in FIG. 2).

Analog watch movement 111 is a quartz crystal or other self-contained, battery-powered electronic analog watch movement well known in the art, such as a Citizen 2026 or other readily available watch movements, and is thus not described in detail here. Analog watch movement 111 includes a conventional stem and crown assembly 119 and a conventional analog hand moving assembly 112 that ordinarily would extend through a conventional watch face to couple to an hour hand 108 and a minute hand 109.

FIG. 2 shows LCD display driver 113 in cross-section, adjacent to analog watch movement 111. LCD display driver 113 is electrically coupled to LCD display 105 via zebra connector 117.

FIG. 2 also shows the relative positions of the edges of display opening 102, interior bezel 110, and LCD display 105 in a preferred wristwatch embodiment. Interior bezel 110 is sized such that the outer edge 105*c* of LCD display 105 is hidden from view through the watch crystal 104. In other words, outer edge 110*a* of interior bezel extends beyond the outer edge 105*c* of LCD display 105. Inner edge 110*b* of interior bezel 110 is smaller than outer edge 105*c* of LCD display 105. Display opening 102 in watch case 101 is sized such that outer edge 110*a* of interior bezel 110 is hidden from the wearer's view. One skilled in the art will recognize that although the wristwatch embodiment of the present invention described in this disclosure depicts a circular design for watch case 101, display opening 102, interior bezel 110, and LCD display 105, the present invention may be practiced in timepieces with other physical shapes (such as square, rectangular, oval, etc.) without departing from the present invention. Moreover, although not shown in FIG. 2, watch case 101 may also include a curved rear surface to insure a comfortable fit at the wrist.

Figure 3A:
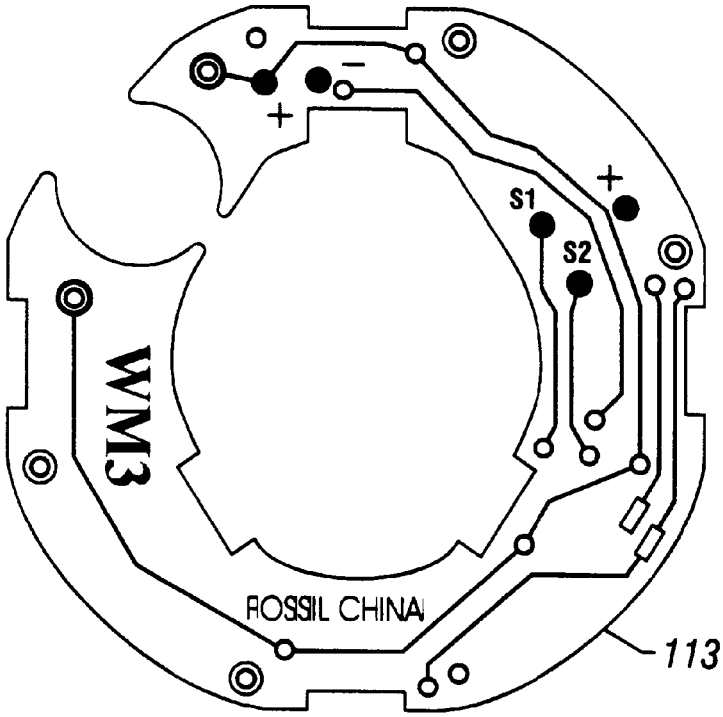
FIGS. 3A and 3B show the front and rear sides of the digital display driver of the present invention according to one embodiment.
Figure 3B:
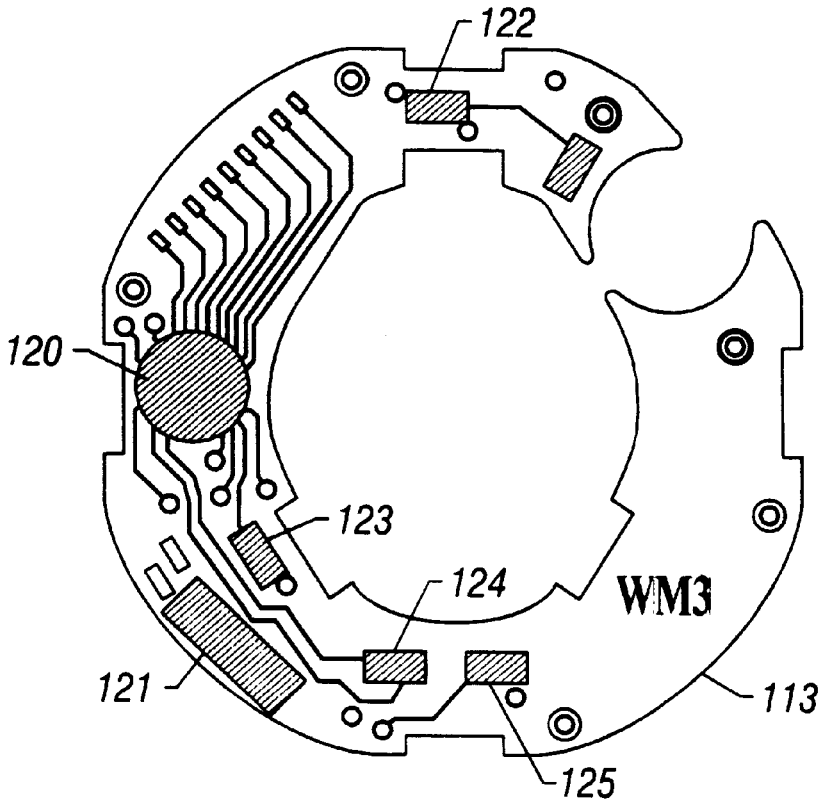

FIGS. 3A and 3B show the front and rear sides of digital display driver 113. Digital display driver 113 includes the timing standard and electronic circuitry necessary to drive the LCD display 105 at a rate of 1 Hz. In the embodiment described in this disclosure, digital display driver 113 comprises a double-sided printed circuit board with the following surface-mounted CMOS electronic components: display driver integrated circuit 120, electronic timing standard 121, and chip capacitors 122–125, all shown in FIG. 3B. Timing circuitry using an electronic timing standard such as a quartz crystal oscillator and electronic LCD display driving circuitry for horological applications are both well known in the prior art and thus no further detail regarding the specifics of display driver 113 is necessary or provided in this disclosure.

Figure 4:
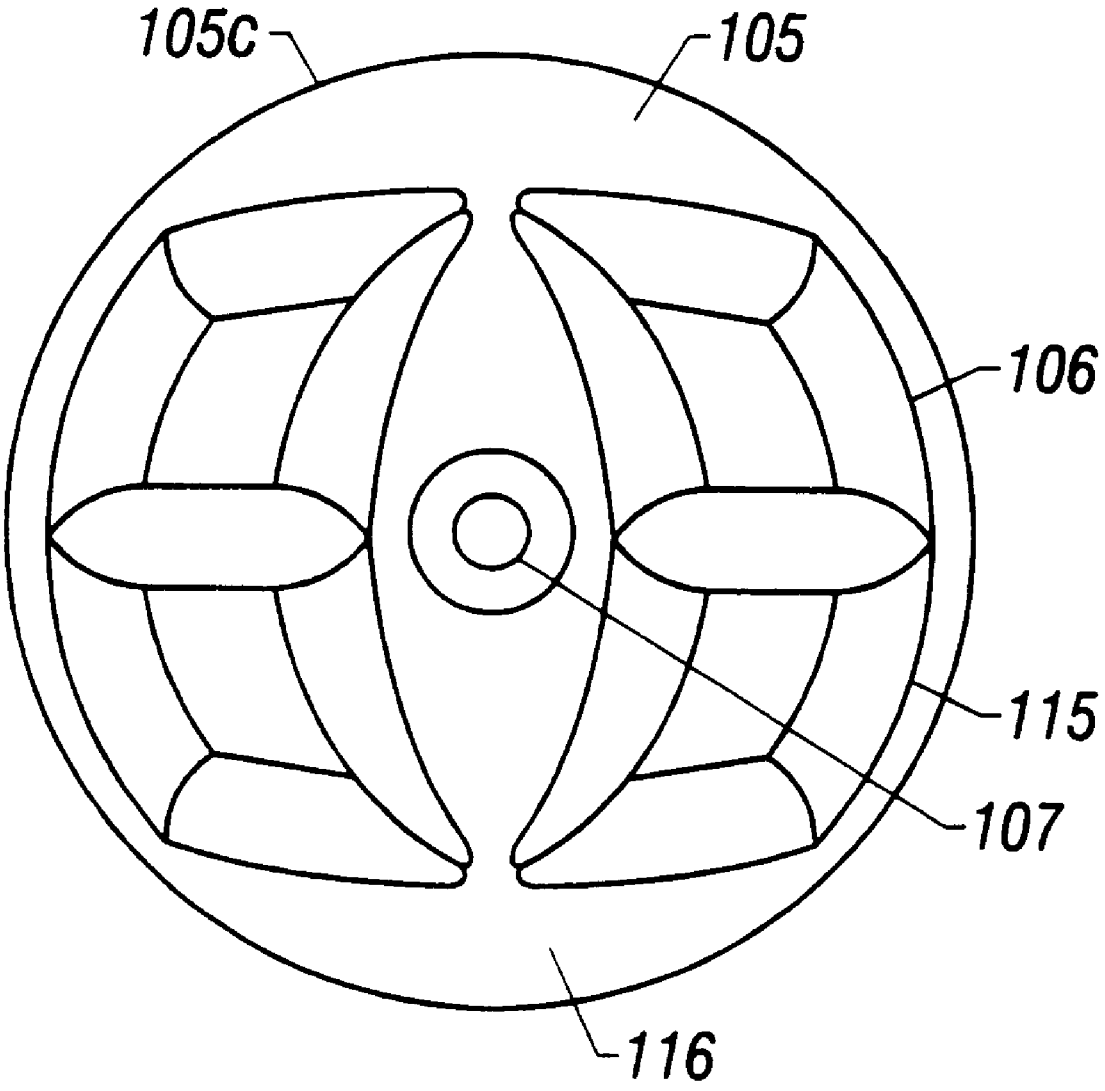
FIG. 4 shows the digital LCD display according to an embodiment of the present invention.
Figure 5:
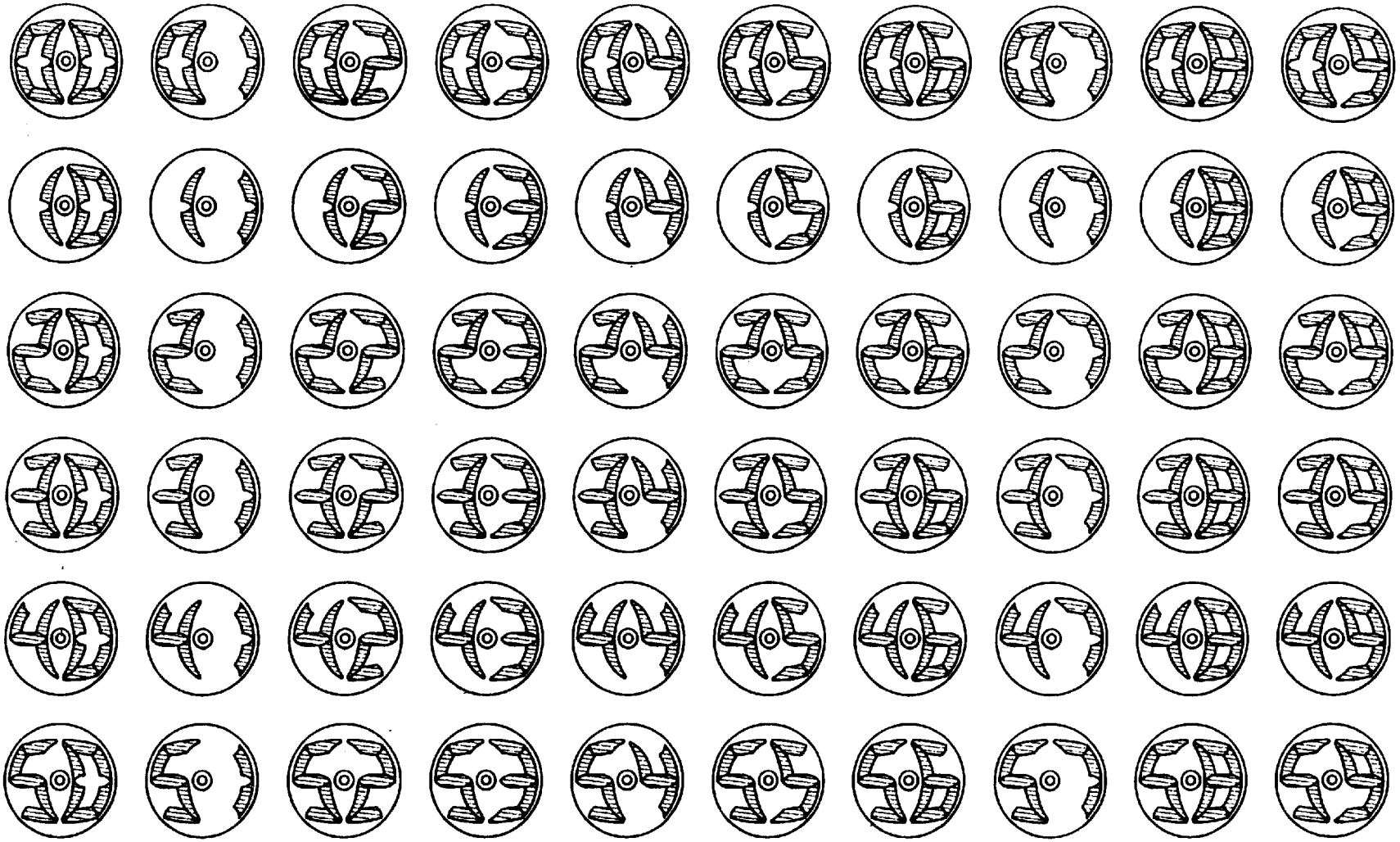
FIG. 5 shows the arrangement of digits of the digital LCD display, according to one embodiment of the present invention.

FIG. 4 shows a close-up view of digital LCD display 105. Features of digital LCD display 105 shown in FIG. 4 include outer edge 105*c*, two alphanumeric displays 106, each of which are comprised of7 uniquely-configured and separately-illuminated segments 115, displaybackground 116 and center aperture 107. Digital LCD display 105 may be configured with an ordinarily-dark background 116 and ordinarily-dark segments 115. When segments 115 are energized by display driver 113 they become light, thus producing light alphanumeric characters 106 on a dark background 116. Alternatively, digital LCD display 105 may be configured with an ordinarily-light background 116 and ordinarily-light segments 115. In this embodiment, when segments 115 are energized by display driver 113, they become dark, thus producing dark alphanumeric characters 106 contrasted with a light background 116. FIG. 5 shows the appearance of dark alphanumeric characters 106 on a light background 116 in an embodiment of the present invention wherein digital LCD display 105 displays alphanumeric characters 00 through 59. One skilled in the art will appreciate that alternative embodiments of the present invention may display alternate characters, such as 01 through 60, 0 through 59 (wherein digits 0–9 are not displayed with a leading 0), or 1 through 60 (wherein digits 1–9 are not displayed with a leading 0). Similarly, embodiments that display only a subset of characters 00–59 or 01–60, at a rate slower than 1 Hz will not depart from the present invention. In other words, an embodiment comprising a digital LCD display that displays alphanumeric characters 00, 10, 20, 30, 40, and 50 for approximately 10 seconds each, but in all other respects identical to this disclosure, would not depart from the present invention. The latter embodiment is not a preferred embodiment, however, because such an embodiment would render the chronometric function of the present invention less useful.

Figure 6:
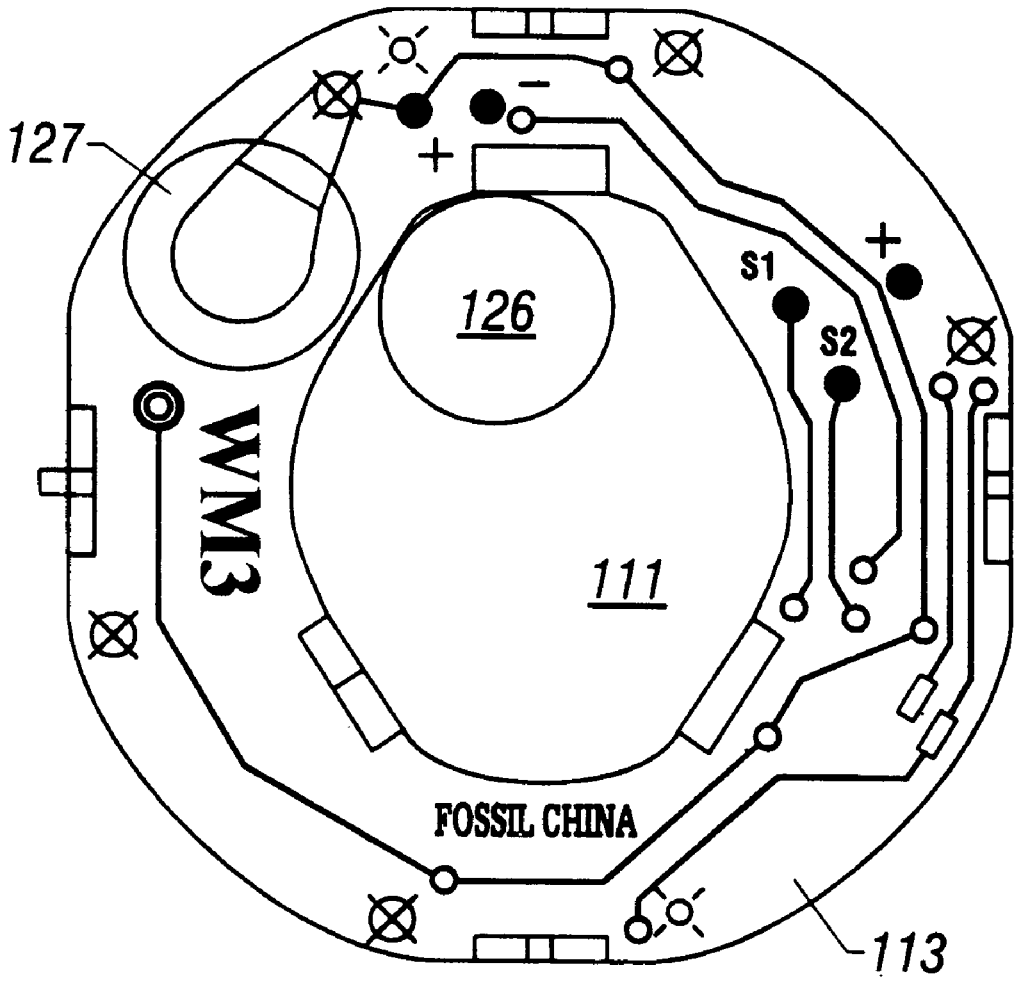
FIG. 6 is rear view of one embodiment of the present invention, showing the arrangement of the analog movement and analog movement battery, and the digital display driver and digital display driver battery.

FIG. 6 is a plan view of a wristwatch embodiment of the present invention from the rear, with the case back 118 removed. FIG. 6 shows the relative positions of analog movement 111 with analog movement battery 126, and digital display driver 113 with digital display driver battery 127. Other than possibly sharing the same electrical ground through watch case 101, analog movement 111 with analog movement battery 126 is electrically isolated from digital display driver 113 and digital display driver battery 127. Consequently, in this embodiment of the present invention, display driver 113 or display driver battery 127 may fail without causing analog movement 111 or analog movement battery 126 to fail and without impacting the ability of the user of the present invention to determine the time of day from the analog display.

In sum, the present invention is a timepiece and chronometer that displays the time of day in an analog display format superimposed over passing seconds displayed alphanumerically on an LCD digital display. The timepiece comprises a watch case with a case back and a display opening that, for the purposes of this disclosure, is designated as the display area, a transparent watch crystal, an electrically-driven digital LCD display that is substantially the same size as the display area, an analog display comprising an hour hand, minute hand, and interior bezel, an electrical analog watch movement, and a digital display driver. The digital LCD display indicates passing seconds by incrementally displaying either digits 00 through 59 or digits 01 through 60 for one second each, either in dark numerals over a light background, or vice versa. The analog display, which may include luminescent surfaces on one or more of its components, is superimposed over the digital display, arranged such that the digital LCD display is viewed through the inner opening of the interior bezel. The hands of the analog display are driven by an electrical analog watch movement located beneath the LCD display that comprises a battery, a timing standard such as a quartz crystal oscillator, timing circuitry, a stem and crown assembly, and a hand moving assembly that extends upward through the center aperture of the LCD display and couples to the analog watch hands. The digital display driver, also located behind the LCD display, couples to the digital LCD display and comprises a second battery, a timing standard such as a quartz crystal oscillator, and timing and display driving electronic components and circuitry. The analog movement and the digital display driver may share the same electrical ground, but otherwise are electrically isolated from one another.

The timepiece may also include markings on the interior bezel that facilitate reading the time of day from the analog display, and/or one or more outer bezels coupled to the watch case outside the display area that may be marked with analog time indications.

Other embodiments of the invention will be apparent to those skilled in the art after considering this specification or practicing the disclosed invention. The specification and examples above are exemplary only, with the true scope of the invention being indicated by the following claims.

What is claimed is:

1. A timepiece for independently displaying the time of day and passing seconds, said timepiece comprising:

a case defining a case interior and having a display opening substantially defined by a periphery of a first side of said case;

a transparent crystal coupled to said case at said case opening and covering said display opening;

an analog watch movement including a first timing circuit retained within said case interior, said analog movement coupled to an hour hand and a minute hand for displaying the time of day in hours and minutes; and a digital display circuit retained within said case interior, said digital display circuit including a digital display coupled to a second timing circuit for indicating passing seconds, wherein said second timing circuit is independent from said first timing circuit and said digital display is positioned below said hour and minute hands whereby a viewer can simultaneously see said passing seconds on said display element and said hour and minute hands through said transparent crystal.

2. The timepiece according to claim 1 wherein said digital display is substantially of equal size to said display opening.

3. The timepiece according to claim 2 further comprising an internal bezel about an inner periphery of said display opening.

4. The timepiece according to claim 3 wherein said internal bezel overlaps at least an outer periphery of said digital display and maintains said digital display spaced below said hour and minute hands when viewed in elevation.

5. The timepiece according to claim 4 further including:

a first electrical power source to drive said analog movement; and a second electrical power source to drive said digital display circuit, said first and said second power sources substantially isolated one from the other.

6. The timepiece according to claim 1 wherein said digital display circuit further includes an electronic timing standard for providing signals to drive said digital display.

7. The timepiece according to claim 6 wherein said digital display is substantially of equal size to said display opening.

8. The timepiece according to claim 7 further comprising an internal bezel about an inner periphery of said display opening.

9. The timepiece according to claim 8 wherein said internal bezel overlaps at least an outer periphery of said digital display and maintains said digital display spaced below said hour and minute hands when viewed in elevation.

10. The timepiece according to claim 9 further including:

a first electrical power source to drive said analog movement; and a second electrical power source to drive said digital display, said first and said second power sources substantially isolated one from the other.

* * * * *